US007451513B2

(12) United States Patent
Torres

(10) Patent No.: US 7,451,513 B2
(45) Date of Patent: Nov. 18, 2008

(54) BACK-SCRUBBING AND CLEANSING APPARATUS

(76) Inventor: Reinaldo Torres, 1177 Horseshoe Dr., South Lyon, MI (US) 48178

( * ) Notice: Subject to any disclaimer, the term of this patent is extended or adjusted under 35 U.S.C. 154(b) by 422 days.

(21) Appl. No.: 10/994,881

(22) Filed: Nov. 23, 2004

(65) Prior Publication Data

US 2006/0107473 A1 May 25, 2006

(51) Int. Cl.
*A47K 7/03* (2006.01)
*A46B 13/04* (2006.01)

(52) U.S. Cl. ..... 15/21.1; 4/606

(58) Field of Classification Search ..... 15/21.1, 15/97.1; 4/606
See application file for complete search history.

(56) References Cited

U.S. PATENT DOCUMENTS 3,196,867 A * 7/1965 Perry ..... 601/114
5,239,712 A * 8/1993 Kinder ..... 4/606
5,345,640 A * 9/1994 Goss ..... 15/88.2
5,382,221 A 1/1995 Hsu et al.
5,561,869 A 10/1996 Sarel
D409,337 S 5/1999 Johnson, Jr.
6,174,296 B1 1/2001 Wang
D444,916 S 7/2001 Brown, Sr.
6,996,861 B1 * 2/2006 Clark, Jr. ..... 4/606
7,120,947 B1 * 10/2006 Magallanes ..... 4/606

* cited by examiner

*Primary Examiner*—Randall Chin

(57) ABSTRACT

A back-scrubbing and cleansing apparatus includes a housing that has a plurality of sidewalls defining first and second isolated cavities. One side wall is provided with an inlet port in fluid communication with the first cavity for receiving a liquid cleansing agent therethrough. An end cap is threadably attachable to the inlet. The apparatus further includes a mechanism for removably attaching the housing to the shower wall and a plurality of rotatable scrubbing elements attached to another one of the sidewalls. The scrubbing elements include a plurality of resilient bristles. A mechanism is included for assisting a user to more effectively clean the selected body portion during operating conditions.

15 Claims, 6 Drawing Sheets

BACK-SCRUBBING AND CLEANSING APPARATUS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a scrubbing apparatus and, more particularly, to a back-scrubbing and cleansing apparatus for cleaning a user's backside.

2. Prior Art

The use of brushes is known in the prior art. More specifically, brushes heretofore devised and utilized for the purpose of cleaning a user's back are known to consist basically of familiar, expected and obvious structural configurations, notwithstanding the myriad of designs encompassed by the crowded prior art which have been developed for the fulfillment of countless objectives and requirements.

One example is a back scrubber which contains a bar of soap for application by bathers and others who need a convenient way to clean hard to reach areas along their backs. The back scrubber will securely engage a conventional soap bar and when the bar has been substantially consumed, a releasable jaw allows for easy substitution of a fresh bar of soap.

Another example shows a water-powered back scrubber which incorporates a reciprocating brush operated by a water pump that utilizes water diverted from a shower head supply line. The device includes a supporting member securely mounted to a wall of the shower which supports the reciprocating brush so as to allow the same to move up and down as directed by the water pump.

While these devices fulfill their respective, particular objectives and requirements, the aforementioned may be hard to use by individuals who are physically disabled or too old to manipulate the devices in a manner appropriate to their design. Obese individuals may also find it difficult to reach and properly clean all the areas of their back with such devices.

Accordingly, a need remains for a back-scrubbing and cleansing apparatus in order to overcome the above-noted shortcomings. The present invention satisfies such a need by providing an apparatus that is light weight, effective, easy to use and install, portable, and provides superior cleaning. Such a back-scrubbing and cleansing apparatus is ideal for pregnant, obese and disabled individuals who have limited physical movement. The automatically activated apparatus conveniently allows an individual to simultaneously perform other tasks like washing their hair while their back is cleaned, thus saving them both time and energy.

BRIEF SUMMARY OF THE INVENTION

In view of the foregoing background, it is therefore an object of the present invention to provide a back-scrubbing and cleansing apparatus. These and other objects, features, and advantages of the invention are provided by an apparatus attachable to a shower wall for cleaning a user's backside.

The apparatus includes a housing that has a plurality of integral sidewalls sized and shaped for defining first and second isolated cavities therebetween. One such sidewall is provided with an inlet port in fluid communication with the first cavity for selectively receiving a liquid cleansing agent therethrough from an exterior of the housing. The housing includes an end cap threadably attachable to the inlet port for advantageously preventing foreign debris from entering therethrough.

A mechanism for removably attaching the housing to the shower wall is included such that a user can conveniently and readily adjust a position of the housing for targeting a selected body portion. The attaching mechanism preferably includes a plurality of articulated suction cups connected to another one of the sidewalls. Such a sidewall is provided with a plurality of slots defined along horizontal and vertical axes. Each of the suction cups includes an anchor portion respectively positioned within an associated one of the slots such that the suction cups can conveniently be adapted along the horizontal and vertical axes during operating conditions.

A plurality of rotatable scrubbing elements are attached to another one of the sidewalls and protrude outwardly therefrom such that the scrubbing elements can selectively engage the selected body portion during operating conditions while a user's hands advantageously remains free therefrom. Such scrubbing elements include a plurality of resilient bristles.

The present invention preferably further includes a mechanism for conveniently assisting a user to more effectively clean the selected body portion during operating conditions. In one embodiment, such an assisting mechanism preferably includes a conduit that has an intake end portion disposed within the first cavity and further has a plurality of outlet end portions branching away therefrom. In an alternate embodiment, the outlet end portions are in fluid communication with the first cavity and are operably connected to the scrubbing members wherein the liquid cleansing agent can be extracted from the first cavity for cooperating with the scrubbing members during cleaning applications.

The assisting mechanism may further include a power supply source and a pump electrically coupled thereto and a switch operably connected to the power supply source and to the pump for selectively toggling the pump between operating and non-operating positions. Such a pump is attached to the conduit for automatically extracting the liquid cleansing agent from the first cavity.

The apparatus further includes a power mechanism for advantageously rotating the scrubbing elements in a selected direction and at a selected revolution per minute. Such a power mechanism is contemporaneously operable with the assisting mechanism such that the liquid agent can conveniently be dispensed while the scrubbing elements are rotated.

The power mechanism preferably further includes a plurality of pulleys attached to the scrubbing elements respectively and a plurality of belts operably attached to the pulleys respectively. A motor is directly connected to one of the pulleys for driving the one pulley such that remaining ones of the pulleys are caused to rotate in sync with the one pulley. One such belt defines a drive belt and is directly attached to the one pulley and other selected ones of the pulleys.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
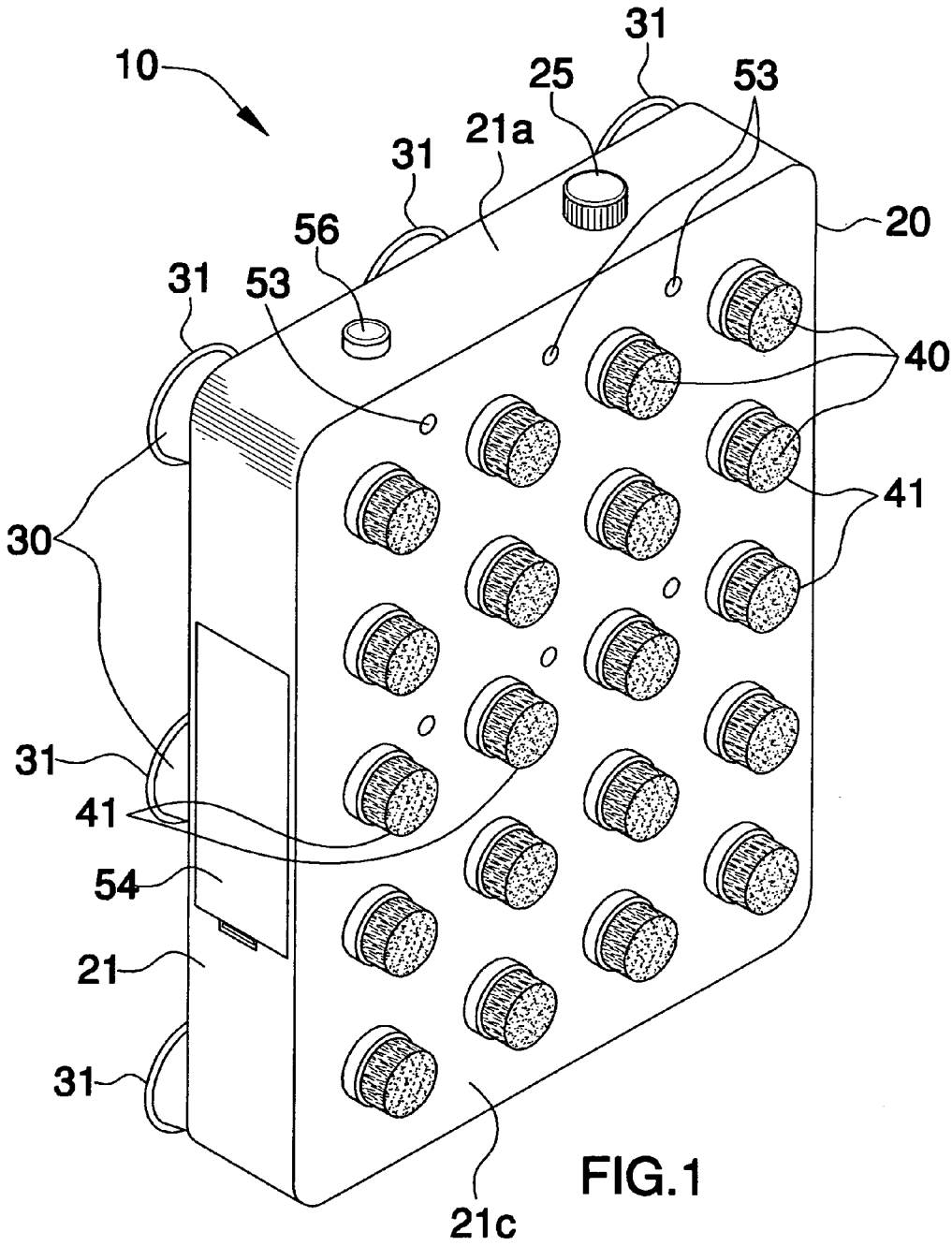
FIG. 1 is a perspective view showing a back-scrubbing and cleansing apparatus, in accordance with the present invention.
Figure 2:
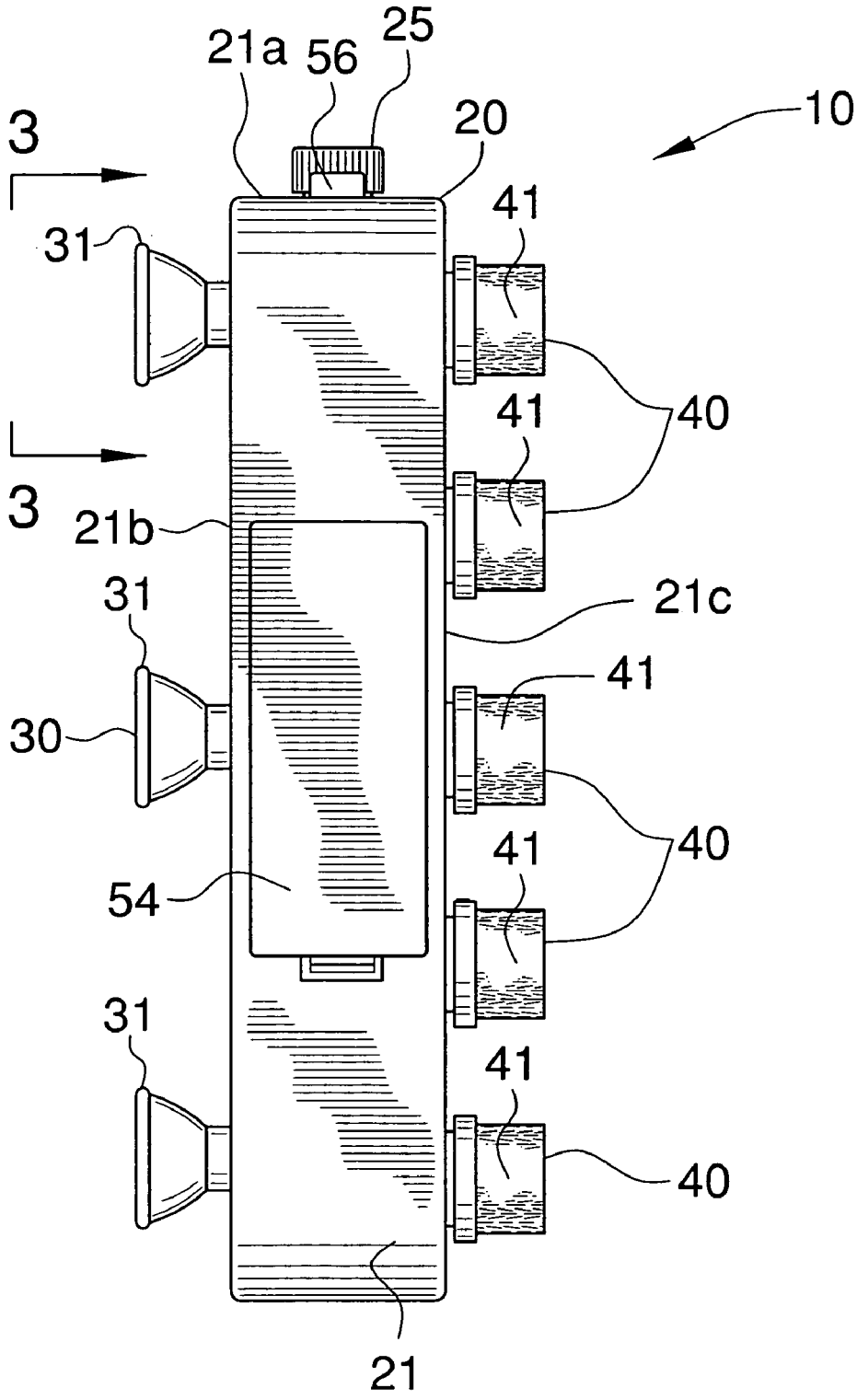
FIG. 2 is a side elevational view of the apparatus shown in FIG. 1.
Figure 3:
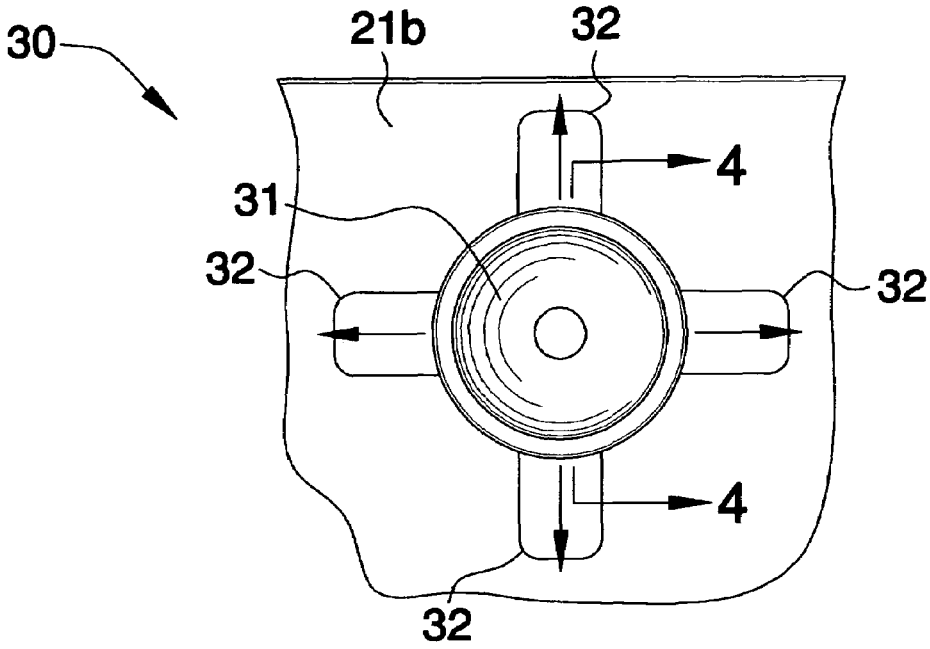
FIG. 3 is a rear elevational view of the apparatus shown in FIG. 1; showing a suction cup.
Figure 4:
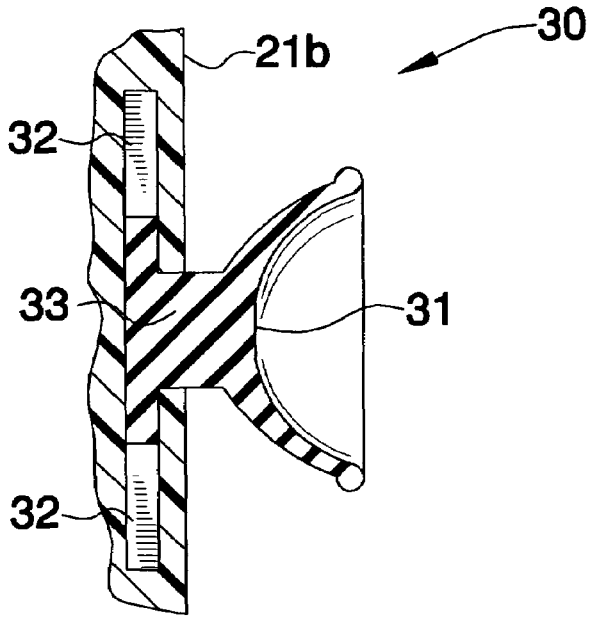
FIG. 4 is a cross-sectional view of the suction cup shown in FIG. 3.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures and prime and double prime numbers refer to alternate embodiments of such elements.

The apparatus of this invention is referred to generally in FIGS. 1-8 by the reference numeral 10 and is intended to provide a back-scrubbing and cleansing apparatus. It should be understood that the apparatus 10 may be used to scrub and clean many different types of body parts and should not be limited to only the backside of an individual's body.

Referring initially to FIG. 1, the apparatus 10 includes a housing 20 that has a plurality of integral sidewalls 21 sized and shaped for defining first 22 and second 23 isolated cavities therebetween. Such a housing 20 may, of course, be offered in a variety of different colors so as to accommodate any decorating scheme, as well known to a person skilled in the art. One such side wall 21*a* is provided with an inlet port 24 in fluid communication with the first cavity 22 for selectively receiving a liquid cleansing agent therethrough from an exterior of the housing 20. The housing 20 includes an end cap 25 threadably attachable to the inlet port 24 for advantageously preventing foreign debris from entering therethrough. By preventing foreign debris from entering the first cavity 22, such an end cap 25 further advantageously prevents the conduit 51 (described herein below) from becoming clogged with foreign debris which would render the apparatus 10 inoperable.

Referring to FIGS. 1, 2, 3 and 4, a mechanism 30 for removably attaching the housing 20 to the shower wall is included such that a user can conveniently and readily adjust a position of the housing 20 for targeting a selected body portion. Such an attaching mechanism 30 further allows the apparatus 10 to be adjusted to various heights such that it can conveniently be used by individuals of varying stature and not just, for example, by adults. The attaching mechanism 30 includes a plurality of articulated suction cups 31, which advantageously provide excellent attachment in moist environments such as showers, connected to another one of the sidewalls 21*b*. Such a sidewall 21*b* is provided with a plurality of slots 32 defined along horizontal and vertical axes. Each of the suction cups 31 includes an anchor portion 33 respectively positioned within an associated one of the slots 32 such that the suction cups 31 can conveniently be adapted along the horizontal and vertical axes during operating conditions while remaining within the sidewall 21*b*.

Referring to FIGS. 1, 2, 6, 7 and 8, a plurality of rotatable scrubbing elements 40 are attached to another one of the sidewalls 21*c* and protrude outwardly therefrom such that the scrubbing elements 40, 40' can selectively engage the selected body portion during operating conditions while a user's hands advantageously remains free therefrom for performing other tasks such as washing their hair. Such scrubbing elements 40, 40' include a plurality of resilient bristles 41, 41'. The scrubbing elements 40 advantageously provide automated soothing and relaxing scrubbing pressure that is appreciated by all individuals.

Referring to FIGS. 5, 6, 7 and 8, the present invention further includes a mechanism 50 for conveniently assisting a user to more effectively clean the selected body portion during operating conditions. In one embodiment 10, such an assisting mechanism 50 includes a conduit 51, 51' that has an intake portion 52 disposed within the first cavity 22 and further has a plurality of outlet end portions 53 branching away therefrom. In an alternate embodiment 10', the outlet end portions 53' are in fluid communication with the first cavity 22 and are operably connected to the scrubbing members 40, 40' wherein the liquid cleansing agent can be extracted from the first cavity 22 for cooperating with the scrubbing members 40, 40' during cleaning applications. Such an assisting mechanism advantageously eliminates the need for the use of a bar of soap that tends to slip and fall from a user's hands and further eliminates the need for a cumbersome back washing brush, as is well known in the industry.

Referring to FIGS. 1, 2, 5, 6 and 7, the assisting mechanism 50 further includes a power supply source 54 and a pump 55 electrically coupled thereto and a switch 56 operably connected to the power supply source 54 and to the pump 55 for selectively toggling the pump 55 between operating and non-operating positions. Such a pump 55 is attached to the conduit 51 for automatically extracting the liquid cleansing agent from the first cavity 22.

Figure 5:
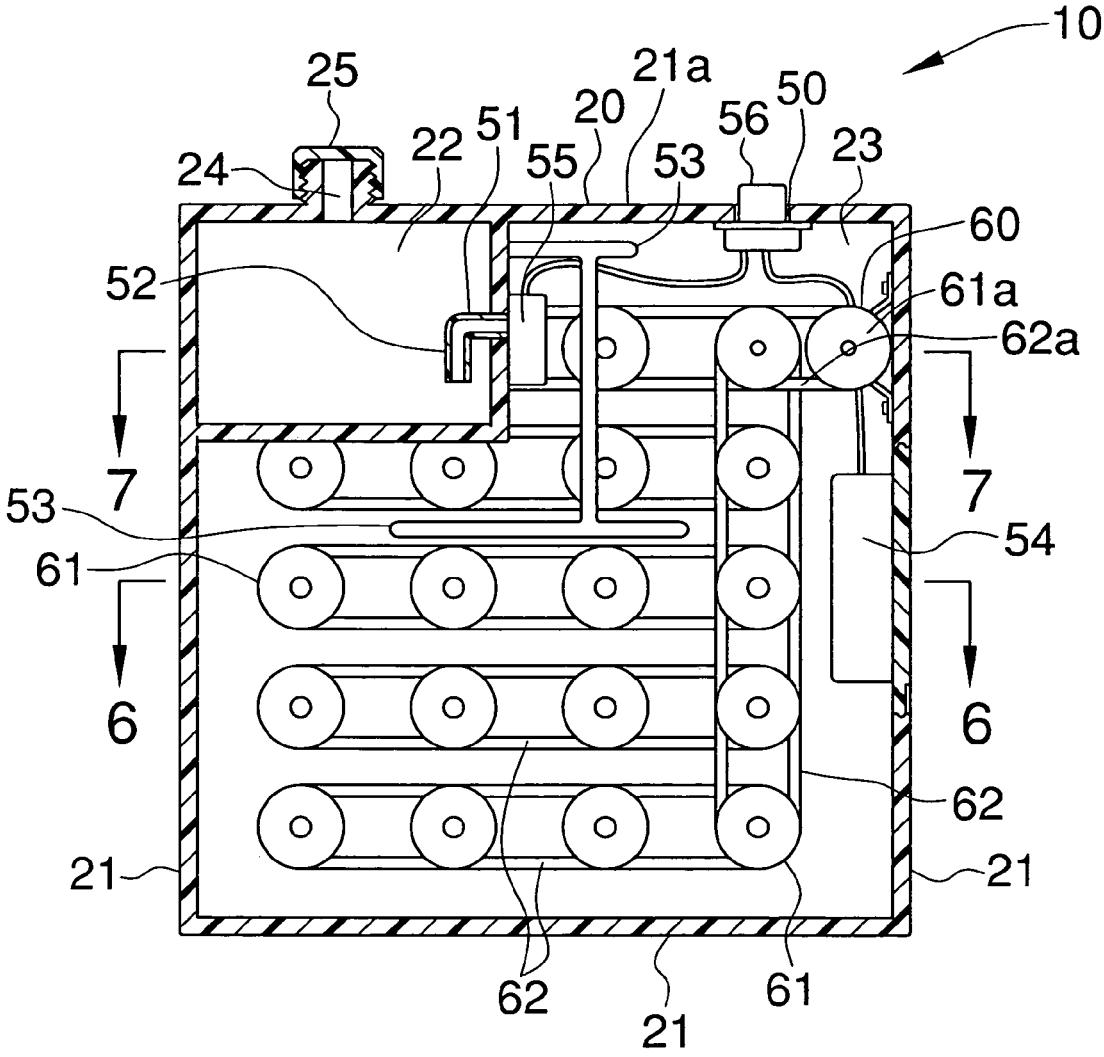
FIG. 5 is a cross-sectional view of the apparatus showing the first and second cavities and the power mechanism.
Figure 6:
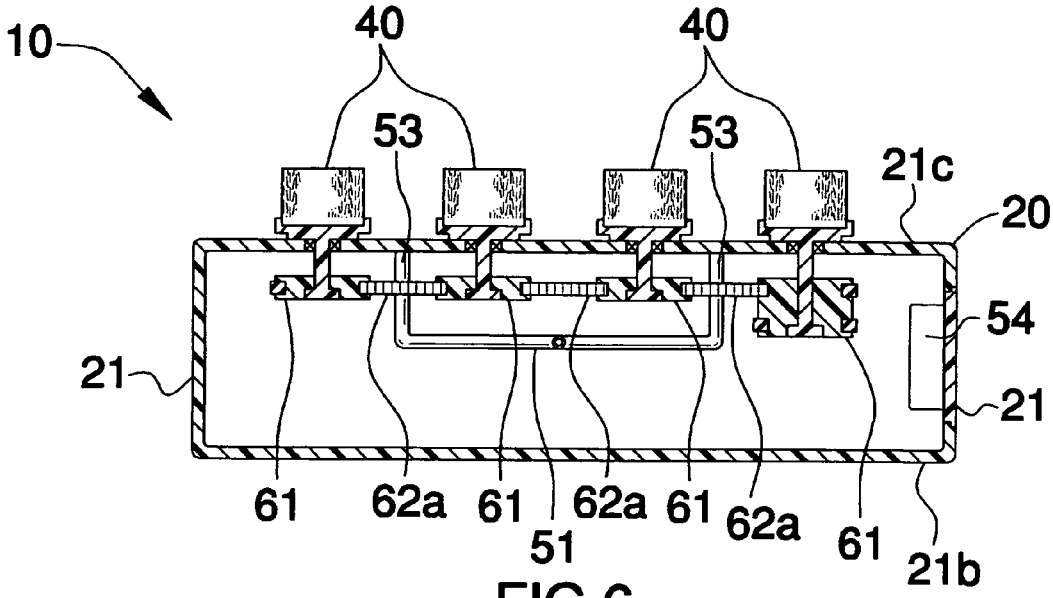
FIG. 6 is a cross-sectional view of the apparatus shown in FIG. 5, taken along line 6-6
Figure 7:
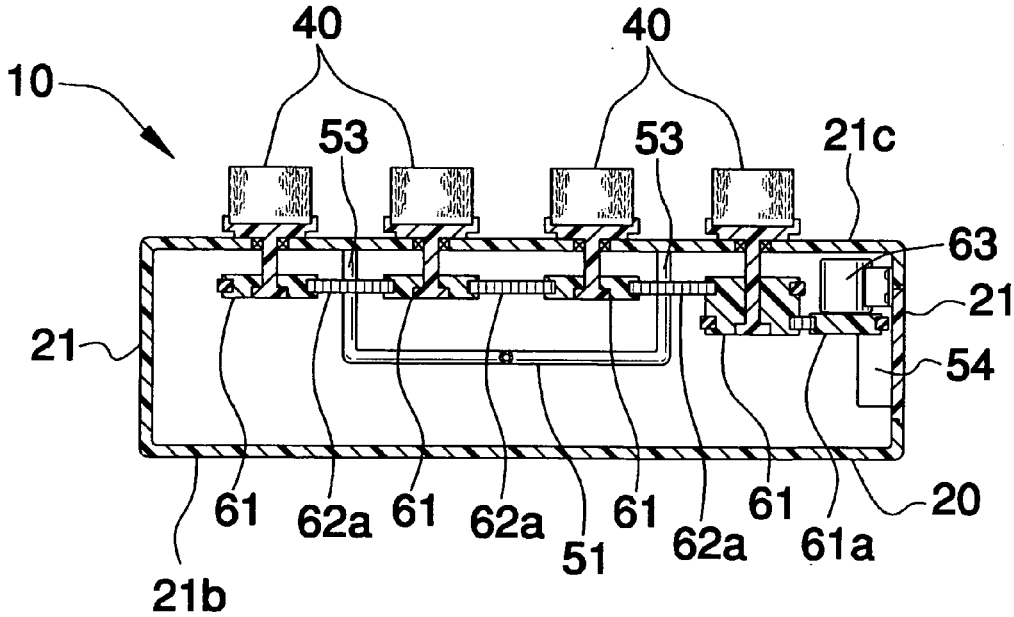
FIG. 7 is a cross-sectional view of the apparatus shown in FIG. 5, taken along line 7-7 and showing the motor for the pulleys.
Figure 8:
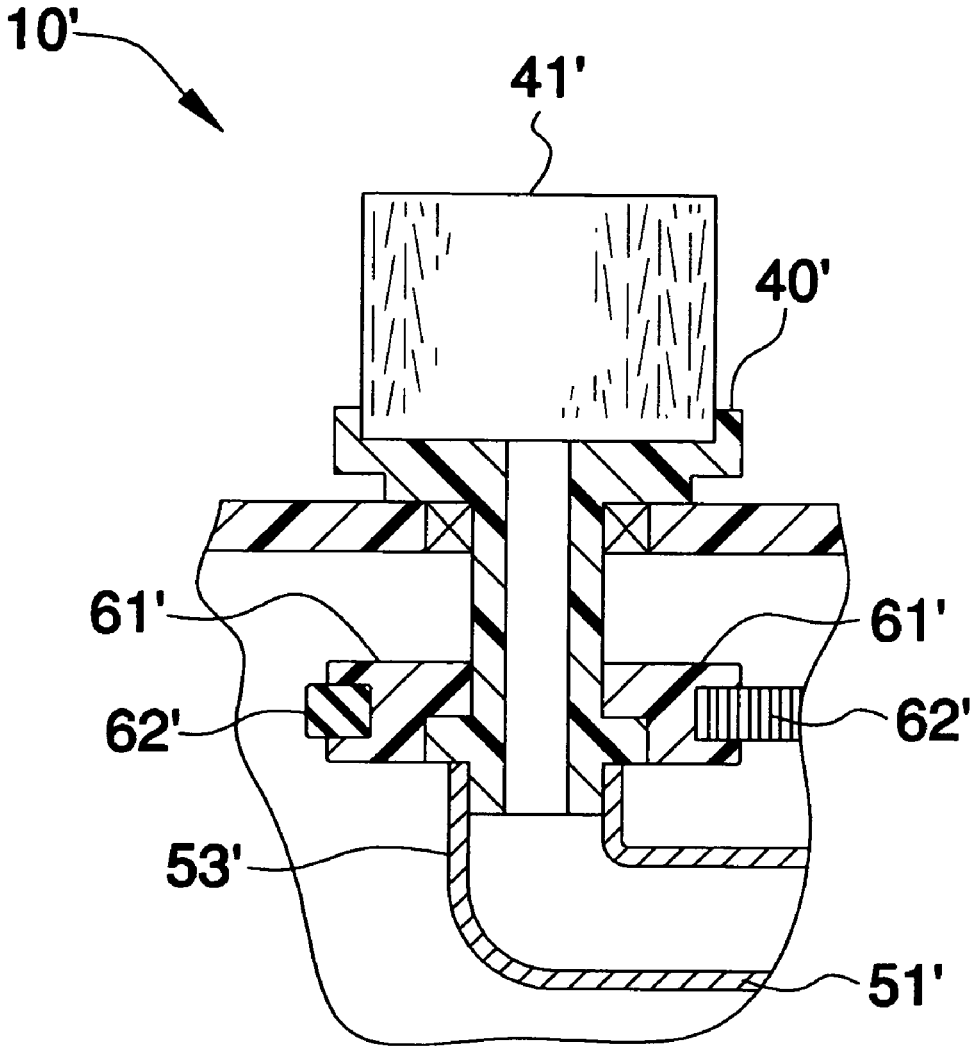
FIG. 8 is an enlarged cross-sectional view showing an alternate embodiment of the dispensing mechanism wherein the conduit attached directly to a scrubbing element.

Referring to FIGS. 5, 6 and 7, the apparatus 10 further includes a power mechanism 60 for advantageously rotating the scrubbing elements 40 in a selected direction and at a selected revolution per minute. Such a power mechanism 60 is contemporaneously operable with the assisting mechanism 50 such that the liquid agent can conveniently be dispensed while the scrubbing elements 40 are rotated.

Still referring to FIGS. 5, 6, 7, and 8 the power mechanism 60 further includes a plurality of pulleys 61 attached to the scrubbing elements 40, 40' respectively and a plurality of belts 62, 62' operably attached to the pulleys 61, 61' respectively. A motor 63 is directly connected to one of the pulleys 61*a* for driving the one pulley 61*a*such that remaining ones of the pulleys 61, 61' are caused to rotate in sync with the one pulley 61*a*. One such belt 62, 62' defines a drive belt 62*a* and is directly attached to the one pulley 61*a* and other selected ones of the pulleys 61, 61'.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An apparatus attachable to a shower wall for cleaning a user's backside, said apparatus comprising:

a housing having a plurality of integral sidewalls sized and shaped for defining first and second isolated cavities therebetween, one said sidewalls being provided with an inlet port in fluid communication with said first cavity and for selectively receiving a liquid cleansing agent therethrough from an exterior of said housing;

means for removably attaching said housing to the shower wall such that a user can readily adjust a position of said housing for targeting a selected body portion;

a plurality of rotatable scrubbing elements attached to another said sidewalls and protruding outwardly therefrom such that said scrubbing elements can selectively engage the selected body portion during operating conditions while a user's hands remain free therefrom; and means for assisting a user to more effectively clean the selected body portion during operating conditions;

wherein said attaching means comprises; a plurality of articulated suction cups connected to another said sidewalls, said another sidewall being provided with a plurality of slots defined along horizontal and vertical axes, each said suction cups including an anchor portion respectively positioned within an associated one of said slots such that said suction cups can be adapted along the horizontal and vertical axes during operating conditions.

2. The apparatus of claim 1, wherein said assisting means comprises:

a conduit having an intake end portion disposed within said first cavity and further having a plurality of outlet end portions branching away therefrom, said outlet end portions being in fluid communication with said first cavity and being operably connected to said scrubbing elements wherein the liquid cleansing agent can be extracted from said first cavity for cooperating with said scrubbing elements during cleaning applications.

3. The apparatus of claim 2, wherein said assisting means further comprises:

a power supply source and a pump electrically coupled thereto; and a switch operably connected to said power supply source and to said pump for selectively toggling said pump between operating and non-operating positions, wherein said pump is attached to said conduit for automatically extracting the liquid cleansing agent from said first cavity.

4. The apparatus of claim 1, further comprising power means for rotating said scrubbing elements in a selected direction and at a selected revolution per minute, said power means being contemporaneously operable with said assisting means such that the liquid agent can be dispensed while said scrubbing elements are rotated.

5. The apparatus of claim 4, wherein said power means further comprises:

a plurality of pulleys attached to said scrubbing elements respectively;

a plurality of belts operably attached to said pulleys respectively; and a motor directly connected to one said pulleys for driving said one pulley such that remaining ones of said pulleys are caused to rotate in sync with said one pulley, one said belts defining a drive belt and being directly attached to said one pulley and other selected ones of said pulleys.

6. An apparatus attachable to a shower wall for cleaning a user's backside, said apparatus comprising:

a housing having a plurality of integral sidewalls sized and shaped for defining first and second isolated cavities therebetween, one said sidewalls being provided with an inlet port in fluid communication with said first cavity and for selectively receiving a liquid cleansing agent therethrough from an exterior of said housing;

means for removably attaching said housing to the shower wall such that a user can readily adjust a position of said housing for targeting a selected body portion;

a plurality of rotatable scrubbing elements attached to another said sidewalls and protruding outwardly therefrom such that said scrubbing elements can selectively engage the selected body portion during operating conditions while a user's hands remain free Therefrom, said scrubbing elements comprising a plurality of resilient bristles; and means for assisting a user to more effectively clean the selected body portion during operating conditions;

wherein said attaching means comprises: a plurality of articulated suction cups connected to another said sidewalls, said another sidewall being provided with a plurality of slots defined along horizontal and vertical axes each said suction cups including, an anchor portion respectively positioned within an associated one of said slots such that said suction cups can be adapted along the horizontal and vertical axes during operating conditions.

7. The apparatus of claim 6, wherein said assisting means comprises:

a conduit having an intake end portion disposed within said first cavity and further having a plurality of outlet end portions branching away therefrom, said outlet end portions being in fluid communication with said first cavity and being operably connected to said scrubbing elements wherein the liquid cleansing agent can be extracted from said first cavity for cooperating with said scrubbing elements during cleaning applications.

8. The apparatus of claim 7, wherein said assisting means further comprises:

a power supply source and a pump electrically coupled thereto; and a switch operably connected to said power supply source and to said pump for selectively toggling said pump between operating and non-operating positions, wherein said pump is attached to said conduit for automatically extracting the liquid cleansing agent from said first cavity.

9. The apparatus of claim 6, further comprising power means for rotating said scrubbing elements in a selected direction and at a selected revolution per minute, said power means being contemporaneously operable with said assisting means such that the liquid agent can be dispensed while said scrubbing elements are rotated.

10. The apparatus of claim 9, wherein said power means further comprises:

a plurality of pulleys attached to said scrubbing elements respectively;

a plurality of belts operably attached to said pulleys respectively; and a motor directly connected to one said pulleys for driving said one pulley such that remaining ones of said pulleys are caused to rotate in sync with said one pulley, one said belts defining a drive belt and being directly attached to said one pulley and other selected ones of said pulleys.

11. An apparatus attachable to a shower wall for cleaning a user's backside, said apparatus comprising:

a housing having a plurality of integral sidewalls sized and shaped for defining first and second isolated cavities therebetween, one said sidewalls being provided with an inlet port in fluid communication with said first cavity and for selectively receiving a liquid cleansing agent therethrough from an exterior of said housing, said housing including an end cap threadably attachable to said inlet port for preventing foreign debris from entering therethrough;

means for removably attaching said housing to the shower wall such that a user can readily adjust a position of said housing for targeting a selected body portion;

a plurality of rotatable scrubbing elements attached to another said sidewalls and protruding outwardly therefrom such that said scrubbing elements can selectively engage the selected body portion during operating conditions while a user's hands remain free therefrom, said scrubbing elements comprising a plurality of resilient bristles; and means for assisting a user to more effectively clean the selected body portion during operating conditions;

wherein said attaching means comprises: a plurality of articulated suction cups connected to another said sidewalls, said another sidewall being provided with a plurality of slots defined along horizontal and vertical axes, each said suction cups including an anchor portion respectively positioned within an associated one of said slots such that said suction cups can be adapted along the horizontal and vertical axes during operating conditions.

12. The apparatus of claim 11, wherein said assisting means comprises:

a conduit having an intake end portion disposed within said first cavity and further having a plurality of outlet end portions branching away therefrom, said outlet end portions being in fluid communication with said first cavity and being operably connected to said scrubbing elements wherein the liquid cleansing agent can be extracted from said first cavity for cooperating with said scrubbing elements during cleaning applications.

13. The apparatus of claim 12, wherein said assisting means further comprises:

a power supply source and a pump electrically coupled thereto; and a switch operably connected to said power supply source and to said pump for selectively toggling said pump between operating and non-operating positions, wherein said pump is attached to said conduit for automatically extracting the liquid cleansing agent from said first cavity.

14. The apparatus of claim 11, further comprising power means for rotating said scrubbing elements in a selected direction and at a selected revolution per minute, said power means being contemporaneously operable with said assisting means such that the liquid agent can be dispensed while said scrubbing elements are rotated.

15. The apparatus of claim 14, wherein said power means further comprises:

a plurality of pulleys attached to said scrubbing elements respectively;

a plurality of belts operably attached to said pulleys respectively; and a motor directly connected to one said pulleys for driving said one pulley such that remaining ones of said pulleys are caused to rotate in sync with said one pulley, one said belts defining a drive belt and being directly attached to said one pulley and other selected ones of said pulleys.

* * * * *